US007227303B2

(12) United States Patent
Bajnok et al.

(10) Patent No.: US 7,227,303 B2
(45) Date of Patent: Jun. 5, 2007

(54) METHOD FOR FORMING COLD SPOT REGION AND DISCHARGE LAMP WITH SUCH COLD SPOT REGION

(75) Inventors: János Bajnok, Lévai u. (HU); András Horváth, Szent Benedek út (HU); Sándor Lukács, Nyár u. (HU)

(73) Assignee: General Electric Company, Schenectady, NY (US)

( * ) Notice: Subject to any disclaimer, the term of this patent is extended or adjusted under 35 U.S.C. 154(b) by 587 days.

(21) Appl. No.: 10/751,156

(22) Filed: Jan. 2, 2004

(65) Prior Publication Data

US 2004/0207326 A1 Oct. 21, 2004

(30) Foreign Application Priority Data

Apr. 16, 2003 (HU) ..... 0301023

(51) Int. Cl.
*H01J 17/44* (2006.01)

(52) U.S. Cl. ..... 313/493; 313/634; 445/26; 445/43

(58) Field of Classification Search ..... 313/493, 313/634; 445/26, 43; 220/2.2
See application file for complete search history.

(56) References Cited

U.S. PATENT DOCUMENTS 2,153,398 A * 4/1939 Sittel ..... 174/17.05
3,957,328 A * 5/1976 VAN DER Wolf et al. ..... 445/9
4,329,166 A 5/1982 Murphy
4,549,251 A 10/1985 Chapman et al.
6,337,539 B1 * 1/2002 Yorifuji et al. ..... 315/56

FOREIGN PATENT DOCUMENTS

JP 57053058 A * 3/1982

* cited by examiner

*Primary Examiner*—Nimeshkumar D. Patel
*Assistant Examiner*—Anthony Perry
(74) *Attorney, Agent, or Firm*—Fay Sharpe LLP

(57) ABSTRACT

A method for forming a cold spot region on a discharge tube of a discharge lamp is disclosed. In the method, a discharge tube is formed, and a tubular extension is formed on at least one end of the discharge tube. The tubular extension has a smaller diameter than the diameter of the discharge tube end. The tubular extension is formed so that a free end of the tubular extension extends away from the end of the discharge tube. A reduced thickness portion is formed on the tubular extension. The reduced thickness portion is formed as a membrane.

A discharge lamp is also disclosed, which comprises a discharge tube with a tubular extension located at an end of the discharge tube. The tubular extension has a smaller diameter than the diameter of the discharge tube end, and the tubular extension comprises a reduced thickness portion. The reduced thickness portion is a membrane, preferably formed of the material of the tubular extension.

20 Claims, 5 Drawing Sheets

METHOD FOR FORMING COLD SPOT REGION AND DISCHARGE LAMP WITH SUCH COLD SPOT REGION

BACKGROUND OF THE INVENTION

This invention relates to a method for forming a cold spot region on a discharge tube of a discharge lamp. The invention further relates to a discharge lamp with a cold spot region, where the cold spot region is constituted by a tubular extension located at an end of the discharge tube.

A wide variety of low pressure discharge lamps are known in the art. The majority of such lamps are so-called compact fluorescent lamps. These lamps comprise a discharge tube. The internal surface of the discharge tube is covered by a luminescent material, usually referred to as phosphor, also commonly termed as light powder. The phosphor emits a visible light when excited by UV radiation. The UV radiation is generated by the interaction of a mercury gas fill in the discharge tube, and the electric discharge between two electrodes. For this purpose, certain low pressure discharge lamps contain small doses of mercury. In order to achieve maximum light output, it is required that the mercury vapour is adjusted and stabilised at a well-defined partial pressure. This is possible by forming a so-called cold spot or cold chamber on the discharge tube, and by selecting an appropriate temperature in the cold spot, which is the coldest location of the gas discharge tube during operation of the lamp. Excess mercury condenses in the cold spot, automatically regulating the partial pressure of the mercury. In this manner, the temperature of the cold spot influences the partial pressure of the mercury in the discharge tube, which in turn directly affects the light output of the lamp.

Generally, compact fluorescent lamps having mercury-filled discharge tubes are tuned to provide maximum ligth output with a cold spot temperature of 40–45° C. The cold spot region of the lamp is normally designed to be on a part of the discharge tube which is relatively far from the driving electronics of the lamp, which latter tend to generate excess heat. For example, it is customary to form a cold spot region on the top of the discharge tube. However, this results in compact fluorescent lamps which may loose up to 20% of their light output in the base-down position (i.e. when the lamp base is below the discharge tube), as compared with the base-up position, because the ascending heat from the electronics and the discharge tube heats the cold spot region of the lamp, and the temperature of the cold spot increases to unacceptable levels.

U.S. Pat. No. 4,549,251 discloses a discharge lamp having a discharge tube bent to a special form. The discharge tube is provided with a long tubular extension at one of its ends. This extension serves as a cool region for the condensation of the mercury. The tubular extension is a remaining part of an exhaust tube, which latter is used to evacuate the discharge tube during manufacture. The exhaust tube is tipped off with a solid glass tip-off. It is explained in the U.S. Pat. No. 4,549,251 that the length of the exhaust tube is chosen to provides an optimum temperature of the cold spot.

U.S. Pat. No. 4,329,166 discloses an automatic tipping-off apparatus which is specially designed to perform the tipping-off of exhaust tubes of low pressure discharge lamps. Such an apparatus is capable of providing a hermetic sealing of the exhaust tube with an approximate wall thickness of 1 mm. This known apparatus is expressly designed with the aim of providing a uniform thickness of the tip portion of the exhaust tube. It is not taught or hinted that a non-uniform thickness of the exhaust tube could be advantageous.

It has been found that such known methods of providing a cold spot region are not satisfactory for compact fluorescent lamps which are designed to operate in a base-down position, and where the ends of the discharge tube are hidden within the lamp housing. Even with improved ventilation of the lamp housing, the wall thickness of the exhaust tube does not allow sufficient dissipation of the heat from the cold spot. Firstly, there are practical limits to the length of the exhaust tube, as a longer exhaust tube will tend to brake off during manufacture or other handling of the lamp. Secondly, even with a relatively long exhaust tube, the thermal load from the discharge volume is higher than the heat dissipation through the glass wall of the exhaust tube.

Therefore, there is a need for a discharge lamp with a more efficiently cooled cold spot region, which allows the operation of the lamp in a substantially arbitrary position, without any significant loss of the light output. There is also need for a method for manufacturing such a discharge lamp. It is sought to provide a method, which, beside providing the required efficiently cooled cold spot region, is relatively simple and which does not require expensive components and complicated manufacturing facilities, and which may be integrated into various types of existing production lines in a straightforward manner.

SUMMARY OF THE INVENTION

In an exemplary embodiment of the present invention, there is provided a method for forming a cold spot region on a discharge tube of a discharge lamp. In the method, a discharge tube is formed, and a tubular extension is formed on at least one end of the discharge tube. The tubular extension has a smaller diameter than the diameter of the discharge tube end. The tubular extension is formed so that a free end of the tubular extension extends away from the end of the discharge tube. A reduced thickness portion is formed on the tubular extension. The reduced thickness portion is formed as a membrane.

In an exemplary embodiment of another aspect of the invention, there is provided a discharge lamp, which comprises a discharge tube with a tubular extension located at an end of the discharge tube. The tubular extension is formed so that a free end of the tubular extension extends away from the end of the discharge tube. The tubular extension has a smaller diameter than the diameter of the discharge tube end, and the tubular extension comprises a reduced thickness portion. The reduced thickness portion is a membrane.

In an exemplary embodiment of another aspect of the invention, there is also provided a discharge tube having a tubular extension located at an end of the discharge tube. The tubular extension comprises a reduced thickness portion, in which the reduced thickness portion is a membrane formed of the material of the tubular extension.

The disclosed method and lamp ensures a cold spot region at the end of the tubular extension, with a sufficiently low temperature. The membrane formed according to the method has an extremely thin wall, which ensures good heat dissipation and an effective cooling of the small volume at the end of the tubular extenesion, in the immediate vicinity of the membrane. This small volume is sufficient for serving as a cold spot. Due to its small size and its location, the thin membrane at the end of the tubular extension does not compromise the overall mechanical strength of the discharge tube. The method may be readily implemented with manufacturing apparatus of existing production lines.

BRIEF DESCRIPTION OF DRAWINGS

The invention will be now described with reference to the enclosed drawings, where.

DETAILED DESCRIPTION OF THE INVENTION

Figure 1:
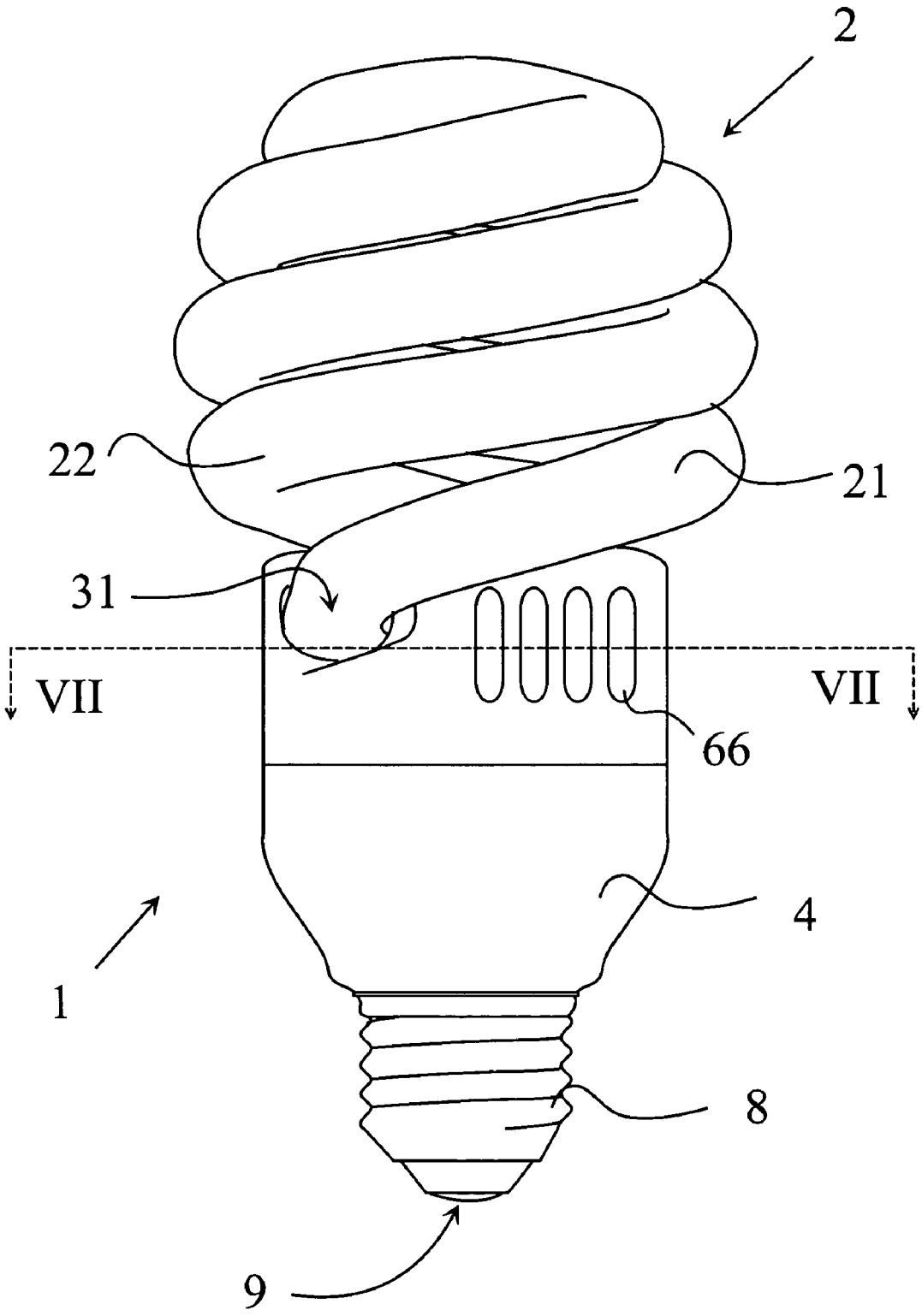
FIG. 1 is a side view of a low pressure discharge lamp with a helical discharge tube, in a base-down position.
Figure 2:
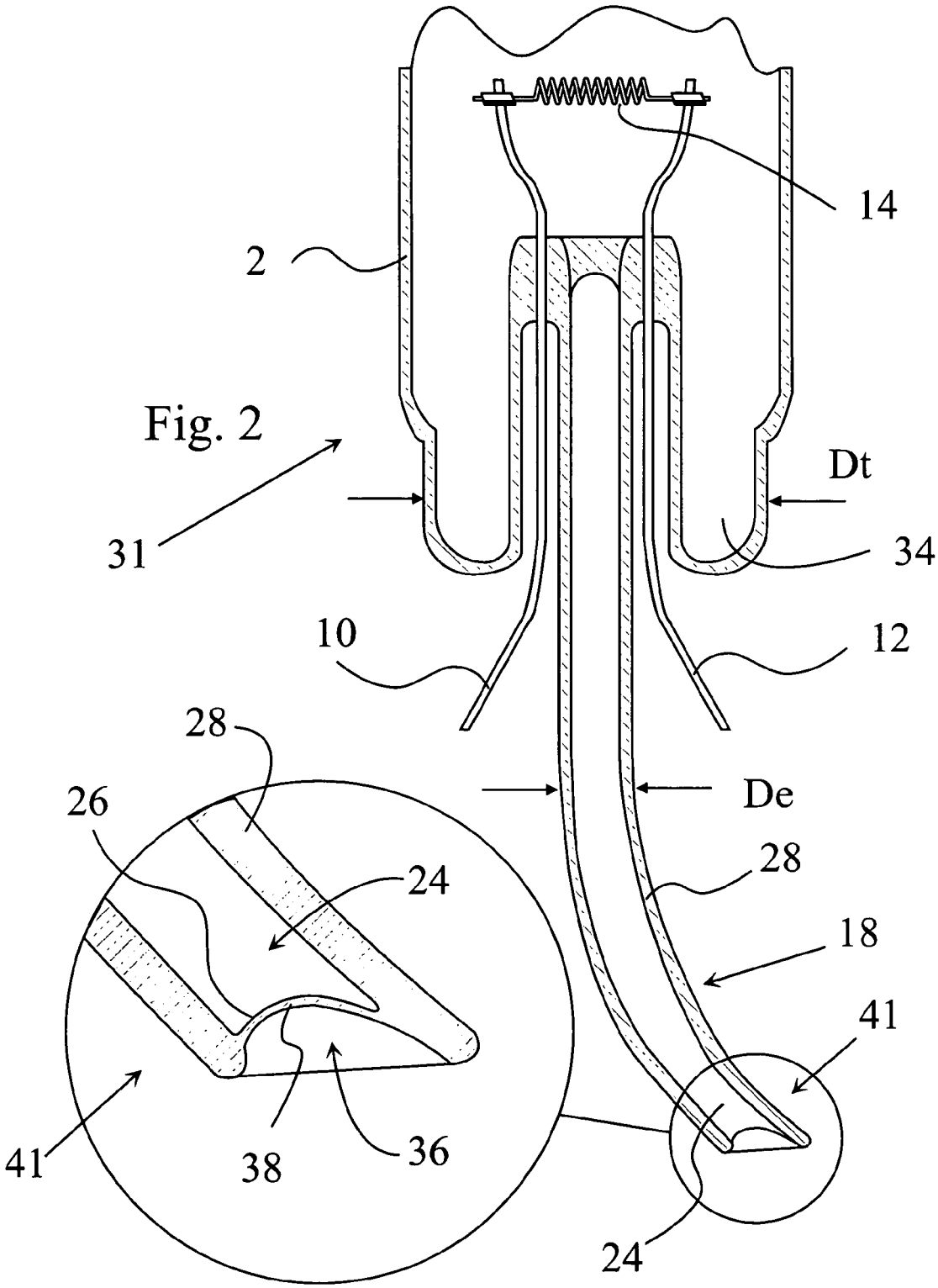
FIG. 2 is an enlarged cross section of an end portion of the lamp shown in FIG. 1, with a remaining part of an exhaust tube and a cold spot region.
Figure 3:
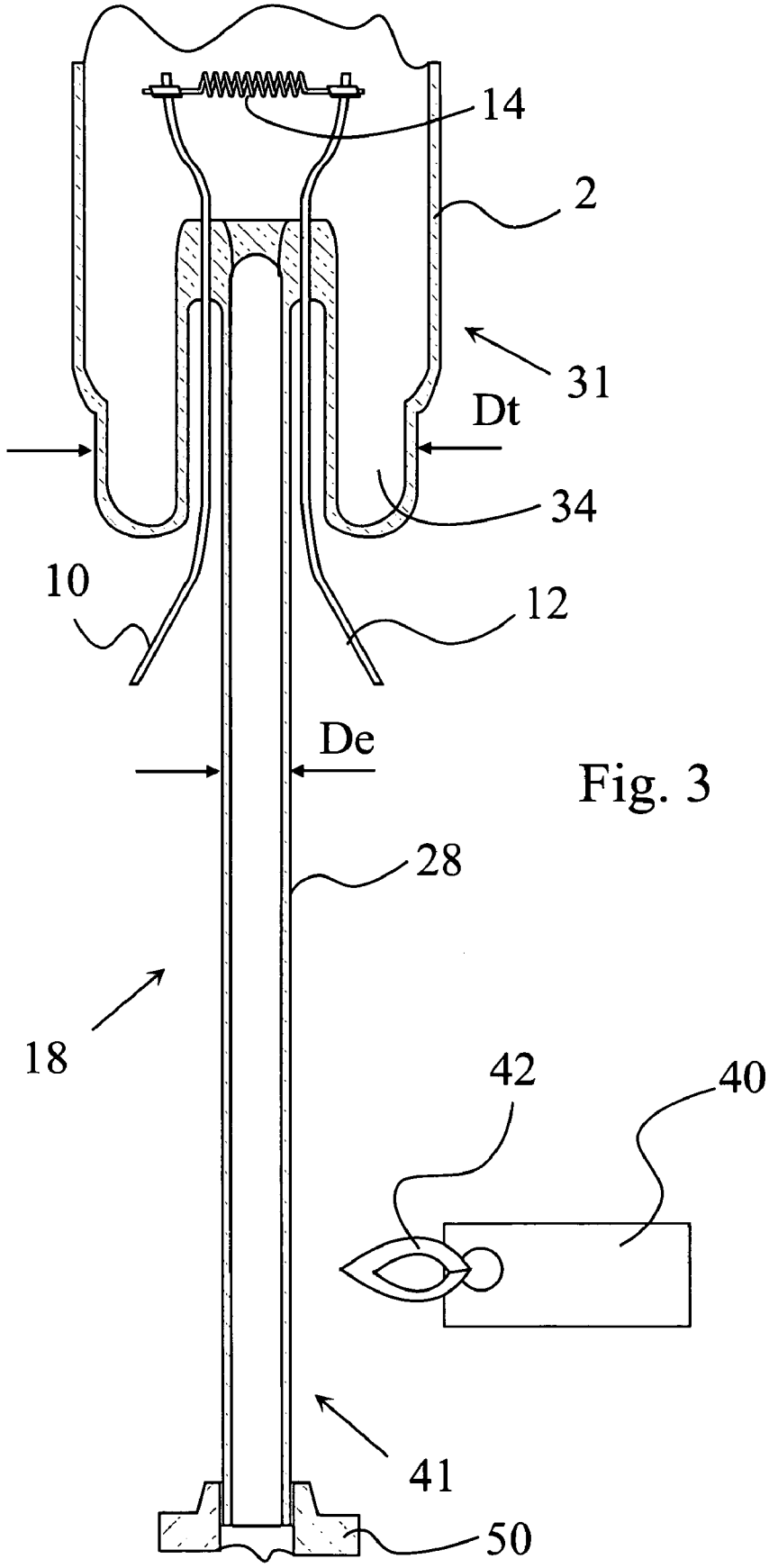
FIG. 3 illustrates a first step in forming the cold spot region on the discharge tube end according to an embodiment of the method of the invention, FIGS. 4 to 6 schematically shows subsequent steps of an embodiment of the method, showing on an enlarged scale the exhaust tube on the discharge tube end of FIG. 3 during different stages of the membrane formation.

Referring now to FIGS. 1 and 2, there is shown a low pressure discharge lamp 1 having a helical discharge tube 2 with two helical tube sections 21,22. Such a discharge lamp 1 is also commonly known as a compact fluorescent lamp, and it is well known in the art, with various tube forms. The discharge tube 2 constitutes a sealed discharge chamber for the discharge process. A lamp housing 4 covers the ends 31 of the discharge tube 2, and also holds the electric contacts 8,9 of the lamp.

Filaments 14 are embedded in the discharge tube 2 at its ends 31. Wires 10,12 connect the filaments 14 to a suitable electric circuitry 16 (see also FIG. 7) within the lamp housing 4. A suitable low pressure gas atmosphere is maintained in the discharge tube 2. The internal surface of the discharge tube 2 is covered with thin layer of fluorescent phosphor, which emits light when excited by UV radiation. The UV radiation is generated by the interaction of a mercury content of the gas atmosphere within the discharge tube 2 and the electric discharge, which latter is maintained with the filament 14 associated to the electric circuitry 16 in the lamp housing 4 of the discharge lamp 1. This arrangement is also known per se.

As best seen in FIG. 2, the discharge tube 2 is provided with a tubular extension 18 located at the end 31 of the discharge tube 2. The tubular extension 18 has a much smaller diameter than the diameter of the discharge tube 2. The free end 41 of the tubular extension 18 extends away from the discharge tube. The tubular extension 18 is an exhaust tube 28, more precisely, it is that part of the exhaust tube 28 which remains on the discharge tube 2 during its manufacture. The exhaust tube 28 shown in FIG. 2 is slightly curved, for the reasons explained below with reference to FIG. 7, however, in other embodiments it may be also straight or even more curved.

As best seen in FIG. 2, the exhaust tube 28 is sealed off at its free end 41 by a membrane 38. This membrane 38 is formed of the same material as the exhaust tube 28, typically glass. As it will be understood from the following explanation, this membrane 38 or pellicle constitutes a reduced thickness portion 36 of the tubular extension 18, which is located at the end 41 of the tubular extension 18. The term "membrane" indicates that the wall thickness of this reduced thickness portion 36 of the tubular extension 18 is so small that its mechanical supporting ability is negligible in a direction perpendicular to its surface, and it can contain only forces which are parallel to its surface, similarly to a membrane made of a flexible material. However, the membrane 38 is still able to withstand the ambient air pressure, partly due to its curved form, which is a result of the manufacturing method explained below with reference to FIGS. 3 to 6.

The volume 24 in the immediate vicinity of the membrane 38, practically the inner surface 26 of the membrane 38 is the cold spot region of the discharge lamp 1. The membrane 38 is very thin, its thickness may be in the order of or even less than 0.1 mm. Therefore, the membrane 38 itself and its surface 26 toward the volume 24 will have a temperature which is significantly closer to the ambient temperature, as compared with other internal parts of the discharge tube 2 and the exhaust tube 28, even during operation of the lamp 1. As a result, the inner surface 26 of the membrane 38 is ideally suited as a cold spot. The provision of the membrane in the exhaust tube 28 is able to lower the cold spot temperature by as much as 6–9° C., as compared with an exhaust tube tip-off having a normal wall thickness. This is further facilitated by locating the membrane 38 as far from the filament 14 as possible. For example, the length of the tubular extension 18, i.e. the exhaust tube 28 in the present embodiment may be as much as 30 mm, however it is typically 8–20 mm, depending on the dimensions of the discharge tube 2 and other parameters of the lamp, such as rated light output, intended field of use, etc. Typically, the diameter of the discharge tube is between 8–20 mm, and the length of the exhaust tube 28 is in the order of the tube diameter or even larger. The diameter of the tubular extension 18 may be between 2–5 mm. Due to the fact that the tubular extension 18 has a smaller diameter De than the diameter Dt of the discharge tube 2 at its end 31, the diameter of the membrane 38 may also remain quite small, and therefore it will not substantially impair the mechanical strength of the discharge tube. Further, the membrane 38 may be located practically within the exhaust tube 28, as in the embodiment shown in FIG. 2, and thereby it is well protected against mechanical impacts.

Turning now to FIGS. 3 to 6, there are illustrated the steps of a possible realisation of the method for forming a cold spot region on a discharge tube 2 of a discharge lamp, such as the discharge lamp 1 of FIG. 1.

The method starts with the formation of a discharge tube 2, in a manner known by itself. Simultaneously with the formation of the discharge tube 2 or subsequently, a tubular extension 18 is formed on at least one end 31 of the discharge tube 2. The tubular extension 18 is formed with a smaller diameter De than the diameter Dt of the discharge tube 2, at least in the region of the discharge tube end 31. Advantageously, as explained above, an exhaust tube 28 is utilised as a tubular extension 18 of the discharge tube 2. The tubular extension 18 is formed so that a free end 41 of the tubular extension 18 extends away from the end 31 of the discharge tube 2. The formation of such a discharge tube 2 with an exhaust tube 28, including the connecting wires 10,12 and the filament 14, is known in the art, and it is not explained and illustrated here in detail.

In an embodiment of the invention, the reduced thickness portion 36 is provided on the tubular extension 18, i.e. on the exhaust tube 28 in the present case. This reduced thickness portion 36 is formed as a membrane 38 (see also FIG. 2). Advantageously, the membrane 38 is formed of the material of the tubular extension 18, on the free end 41 of the tubular extension 18.

Figure 6:
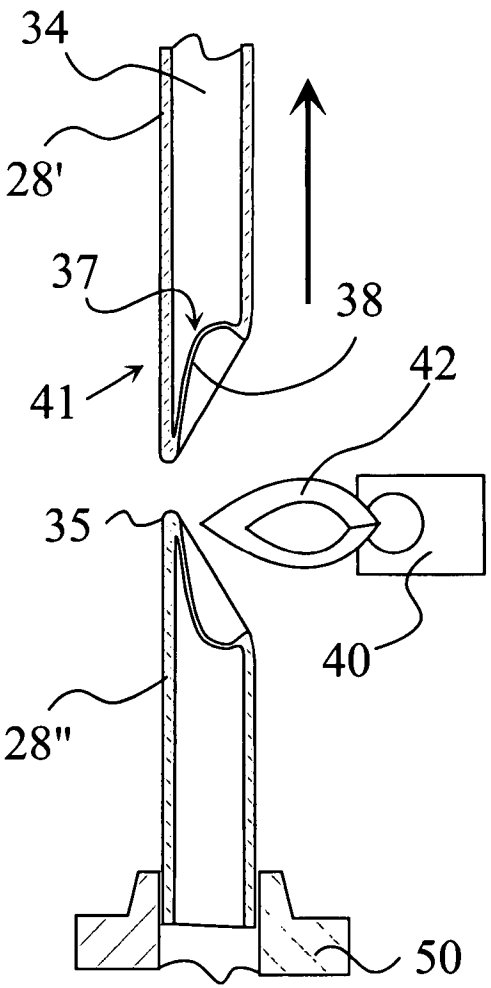
Figure 5:
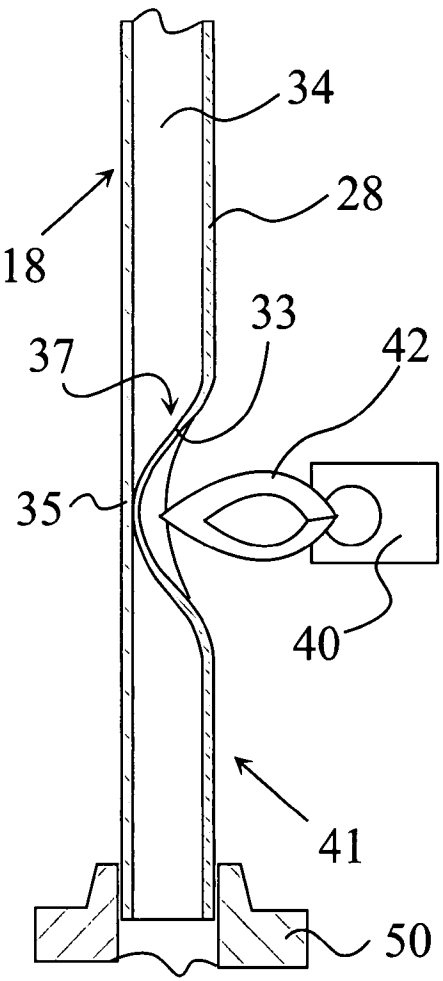
Figure 4:
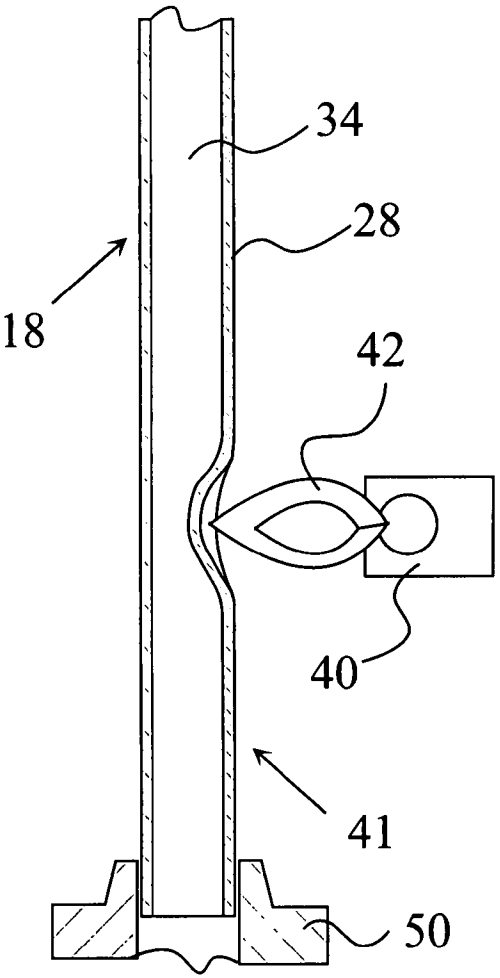

Such a membrane 38 may be formed by a manufacturing process illustrated with reference to FIGS. 4 to 6, which show the free end 41 of the exhaust tube 28. Firstly, a pressure difference is established between the inner volume 34 of the discharge tube 2 and the environmental pressure. In practice, this is done by evacuating the discharge tube 2, either through the exhaust tube 28 or through another orifice of the discharge tube. This evacuation is indicated with the connecting flange 50 of a standard vacuum equipment (not shown). It must be noted that the evacuation of the discharge tube 2 (more precisely, its evacuation and filling with low-pressure gas) is a part of the standard lamp manufacturing process. At the end of this step, the internal pressure of the discharge tube is approx. 4 mbar.

Subsequently or even partly simultaneously with the evacuation, the free end 41 of the tubular extension 18 is heated at the location where it is desired to make the membrane 38. The heating is done with known methods, preferably with the flame 42 of a burner 40. The heating is effected with sufficient energy to melt the material of the tubular extension 18. Typically, the discharge tube 2 is made of glass, so the heating and melting may be done with standard glass forming factory equipment, for example similar to that disclosed in U.S. Pat. No. 4,329,166.

As the material of the tubular extension 28 melts at a location exposed to the flame 42, a bubble-like formation 37 is generated from the molten material, under the effect of the pressure difference between the inner volume 34 of the discharge tube 2 and the external air pressure. FIGS. 4 and 5 show that as the material of the exhaust tube 28 melts, its wall 33 first bulges inwards until the bulge reaches the wall 35 on the opposite side (see FIG. 5). The flame 42 thereafter also melts the wall 35 at the opposite side, allowing a separation of the exhaust tube portions 28',28" attached to the discharge tube 2 and to the flange 50, respectively (see FIG. 6). During this time, the molten glass material will continue to assume a bubble-like formation 37, which begins to bulge into the exhaust tube 28.

It is understood that the bubble-like formation 37 need not be a complete bubble, but merely comprises a curved surface formed by the molten material, where the shape of this curved surface is determined almost exclusively by the pressure on its two sides, the viscosity and tensile strength of the material and the form of its fixed perimeter, similarly to the shape of a soap bubble when blown. In this manner, the wall of the bubble-like formation 37 constitutes a membrane 38 or pellicle. This membrane 38 is formed from the molten material of the tubular extension 18.

Subsequent to the generation of the bubble-like formation 37, the material of the tubular extension 18 is cooled below melting temperature, and the membrane 38 is solidified. If the discharge tube 2 does not have any other orifice, the evacuated discharge tube 2 is sealed simultaneously with the forming of the membrane 38. It is worth noting that by the formation of a bubble-like shape, the membrane 38 will automatically assume a shape which is most suitable to resist the pressure difference between the volume 34 within the discharge tube 2 and the ambient pressure. Also, the membrane 38 will be slightly retracted towards the inside of the exhaust tube 28, thereby shielding the membrane 38 from external mechanical effects. The membrane 38 made with this method may be very thin, in the order of 0.1 mm or even below.

Figure 7:
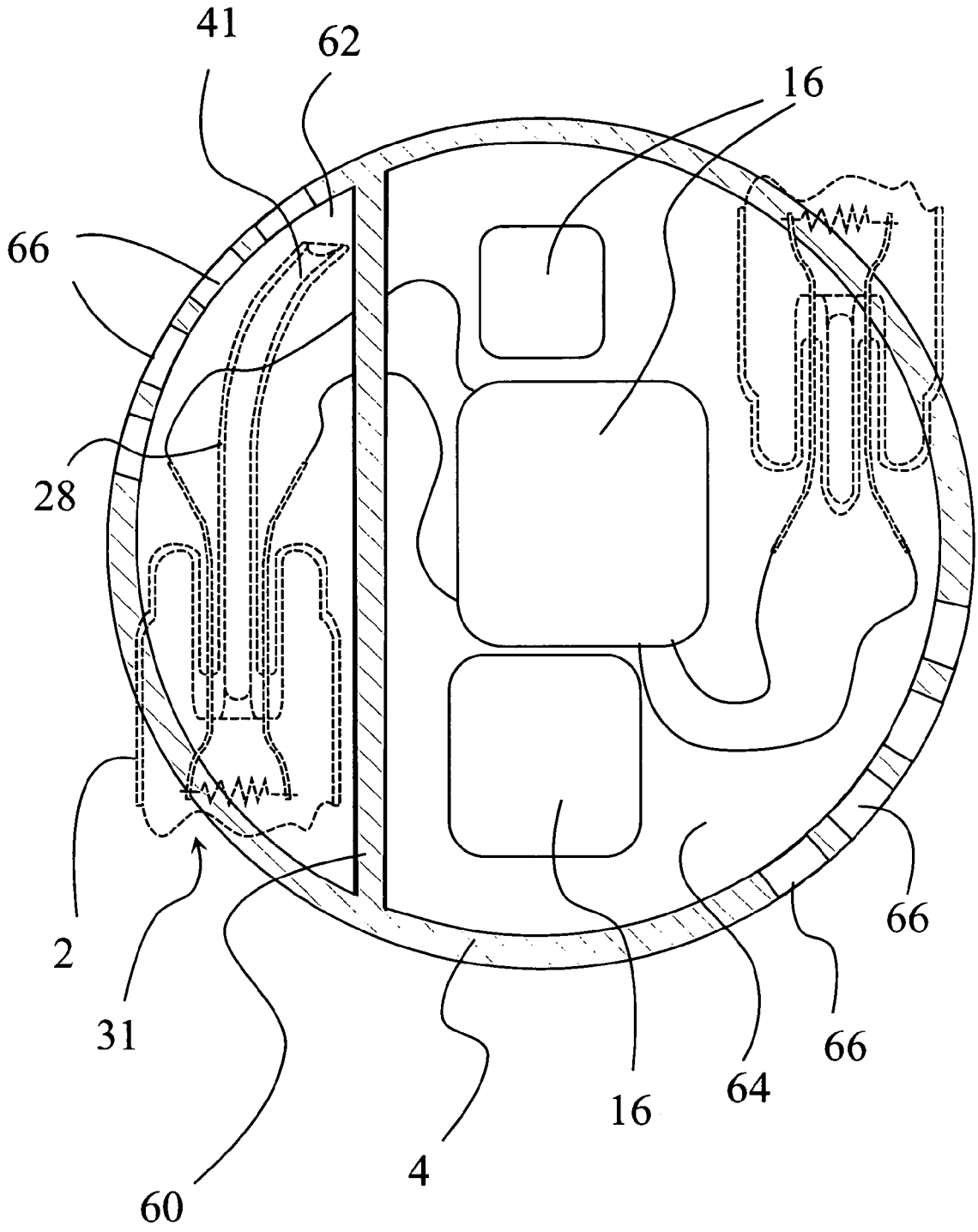
FIG. 7 is a cross section of the lamp housing of the discharge lamp shown in FIG. 1, taken along the plane VII—VII of FIG. 1.

The separation of the discharge tube 2 from the evacuating equipment, the sealing of the discharge tube 2 and the formation of the membrane 38 is thus accomplished in a single process step, not requiring more time than a few seconds. With careful tuning of the process parameters, it is possible to adjust the thickness of the membrane 38 and the depth of its retraction into the exhaust tube 28. The bending of the exhaust tube 28 as illustrated in FIGS. 2 and 7 may take place both prior, during or after the formation of the membrane 38.

It is noted that it is customary to use two or even more opposing flames for tipping off an exhaust tube, or to rotate the exhaust tube while being heated by a single flame. In the suggested method it is recommended to use a single flame only, and without rotating the exhaust tube 28. However, other technologies are also suitable to make a membrane 38 disclosed.

After the manufacture of the discharge tube 2, it is mounted on a lamp housing 4. Referring now to FIG. 7, there is shown an enlarged cross section of the lamp housing 4. As seen in the figure, the lamp housing 4 encloses the ends 31 of the discharge tube 2, and thereby also the end 41 of the tubular extension 18, i.e. that of the exhaust tube 28. It is also seen in the figure that the exhaust tube 28 is curved in order to fit into the lamp housing 4, more precisely into a volume portion of the housing. In order to minimise the heat load on the cold spot region at the free end 41 of the exhaust tube 28, the lamp housing 4 is provided with a partition 60. This partition 60 divides the inner volume of the lamp housing 4 into a first volume portion 64 and a second volume portion 62, and thereby the partition 60 also separates the volume portions 62,64 from each other. The first volume portion 64 contains the drive circuitry 16, while the second volume portion 62 encloses that end 31 of the discharge tube 2 to which the tubular extension 18 is associated. In this manner, the heat generated by the driving circuitry 16 is at least partly isolated from the cold spot region on the end 41 of the exhaust tube 28.

The cooling of the cold spot region of the discharge tube 2 is further enhanced by providing ventilation slots 66 on the lamp housing 4, at least in the region of the second first volume portion 62. However, such ventilation slots 66 may be also provided for the volume portion 64 enclosing the electric circuitry 16, as illustrated with the embodiment shown in FIG. 7.

The invention is not limited to the shown and disclosed embodiments, but other elements, improvements and variations are also within the scope of the invention. For example, it is clear for those skilled in the art that the tubular extension need not be the exhaust tube of the discharge tube—though it is preferred—, but a tubular extension dedicated solely to the provision of a membrane may be provided on the discharge tube. Also, a membrane may be provided on both ends of the discharge tube. Such a cold spot region may be formed not only on helical lamps, but on all types of compact fluorescent lamps. The membrane may be formed also on a quite short exhaust tube tip-off.

The invention claimed is:

1. Method for forming a cold spot region on a discharge tube of a discharge lamp, comprising the steps of forming a discharge tube, forming a tubular extension on at least one end of the discharge tube, the tubular extension having a smaller diameter than the diameter of the discharge tube end, a free end of the tubular extension extending away from the discharge tube end, forming a reduced thickness portion on the tubular extension, the reduced thickness portion being formed as a membrane.

2. The method of claim 1, in which the membrane is formed of the material of the tubular extension.

3. The method of claim 1, in which the membrane is formed on the free end of the tubular extension.

4. The method of claim 1, in which forming the membrane comprises the steps of:

a, establishing a pressure difference between the inner volume of the discharge tube and the environmental pressure, b, heating the free end of the tubular extension and melting the material of the tubular extension, c, generating a bubble formation from the molten material of the tubular extension under the effect of the pressure difference between the inner volume of the discharge tube and the environmental pressure, the wall of the bubble formation constituting a membrane from the molten material of the tubular extension, d, subsequent to the generation of the bubble formation, cooling the material of the extension and solidifying the membrane.

5. The method of claim 1, in which an exhaust tube of the discharge tube serves as the tubular extension.

6. The method of claim 1, in which the pressure difference is established by evacuating the discharge tube.

7. The method of claim 6, in which the evacuated discharge tube is sealed simultaneously with the forming of the membrane.

8. A discharge lamp comprising a discharge tube, a tubular extension located at an end of the discharge tube, the tubular extension having a smaller diameter than the diameter of the discharge tube end, a free end of the tubular extension extending away from the discharge tube end, the tubular extension further comprising a reduced thickness portion, the reduced thickness portion being a membrane.

9. The discharge lamp of claim 8, in which the membrane is formed of the material of the tubular extension.

10. The discharge lamp of claim 8, in which the reduced thickness portion is at the end of the tubular extension.

11. The discharge lamp of claim 8, in which the tubular extension is an exhaust tube.

12. The discharge lamp of claim 11, in which the membrane seals off the end of the exhaust tube.

13. The discharge lamp of claim 8, in which the lamp comprises a lamp housing, the lamp housing enclosing the end of the tubular extension.

14. The discharge lamp of claim 13, in which the lamp housing encloses drive electronics of the lamp, the lamp housing further comprising a partition, the partition separating a first volume portion containing the drive electronics from a second volume portion containing at least one discharge tube end and an associated tubular extension.

15. The discharge lamp of claim 13, in which the lamp housing further comprises ventilation slots at least in the region of the second volume portion.

16. The discharge lamp of claim 8, in which the thickness of the membrane is in the order of or less than 0.1 mm.

17. The discharge lamp of claim 8, in which the length of the tubular extension is between 8–20 mm.

18. The discharge lamp of claim 8, in which the diameter of the discharge tube is between 8–20 mm.

19. The discharge lamp of claim 8, in which the diameter of the tubular extension is between 2–5 mm.

20. A discharge tube having a tubular extension located at an end of the discharge tube, the tubular extension comprising a reduced thickness portion, the reduced thickness portion being a membrane, the membrane being formed of the material of the tubular extension.

* * * * *